US007381082B2

(12) United States Patent
Lai

(10) Patent No.: US 7,381,082 B2
(45) Date of Patent: Jun. 3, 2008

(54) CONNECTOR ASSEMBLY WITH THE CABLE POSITIONED INSIDE

(75) Inventor: Ming-Chun Lai, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/580,082

(22) Filed: Oct. 13, 2006

(65) Prior Publication Data

US 2008/0090438 A1 Apr. 17, 2008

(51) Int. Cl.
*H01R 4/24* (2006.01)
*H01R 4/26* (2006.01)
*H01R 11/20* (2006.01)

(52) U.S. Cl. ..... 439/417; 439/357

(58) Field of Classification Search ..... 439/417, 439/404, 405, 419, 357
See application file for complete search history.

(56) References Cited

U.S. PATENT DOCUMENTS 5,122,079 A * 6/1992 Locati ..... 439/417
5,125,850 A * 6/1992 Locati ..... 439/404
5,820,403 A * 10/1998 Cheng et al. ..... 439/404

* cited by examiner

*Primary Examiner*—Javaid Nasri
(74) *Attorney, Agent, or Firm*—Rosenberg, Klein & Lee

(57) ABSTRACT

A connector assembly includes a housing, the housing extends upwards to form a pair of elastic retaining arms. A plurality of contacts are received in the housing. A positioning base wedges in the housing, the positioning base has a retaining cavity defined in each of two opposite sides of the positioning base respectively, the inner surface of the retaining cavity protuberates outwards to define a retaining projection for cooperating with the retaining arm. A cable is formed together with the positioning base, one end of the cable is connected to the contacts, the other end of the cable stretches out of the housing.

5 Claims, 5 Drawing Sheets

CONNECTOR ASSEMBLY WITH THE CABLE POSITIONED INSIDE

BACKGROUND OF THE INVENTION

1. Field of the Invention

The present invention relates to a cable and connector assembly, and more particularly to a connector assembly with the cable positioned inside.

2. The Related Art

A conventional plug connector or a socket connector includes a housing and a plurality of contacts received in the housing. A cable is connected to the connector by being soldered to the contacts to form a connector assembly.

However, the cable is connected to the connector just by being soldered to the contacts received in the housing, when the cable is pulled unintentionally, the cable tends to move away from the housing and then the cable is easy to be loosened from the contacts at the soldering portion. As a result, the transmitting of the electronic signal is not stable and even the cable and connector assembly is broken down.

SUMMARY OF THE INVENTION

Accordingly, an object of the present invention is to provide a connector assembly includes a housing, the housing extends upwards to form a pair of elastic retaining arms. A plurality of contacts are received in the housing. A positioning base is wedged in the housing, and has a retaining cavity defined in each of two opposite sides of the positioning base respectively, the inner surface of the retaining cavity protuberates outwards to define a retaining projection for cooperating with the retaining arm. A cable is formed together with the positioning base; one end of the cable is connected to the contacts; the other end of the cable stretches out of the housing.

As the cable is formed together with the positioning base and further the positioning base is positioned in the connector assembly, when the cable is pulled unintentionally, the cable is incapable to move away from the housing and then the cable is impossible to be loosened from the contacts at the soldering portion, as a result, the electrical connection between the housing of the present invention and the cable is stable and the transmitting of the electronic signal is also stable.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
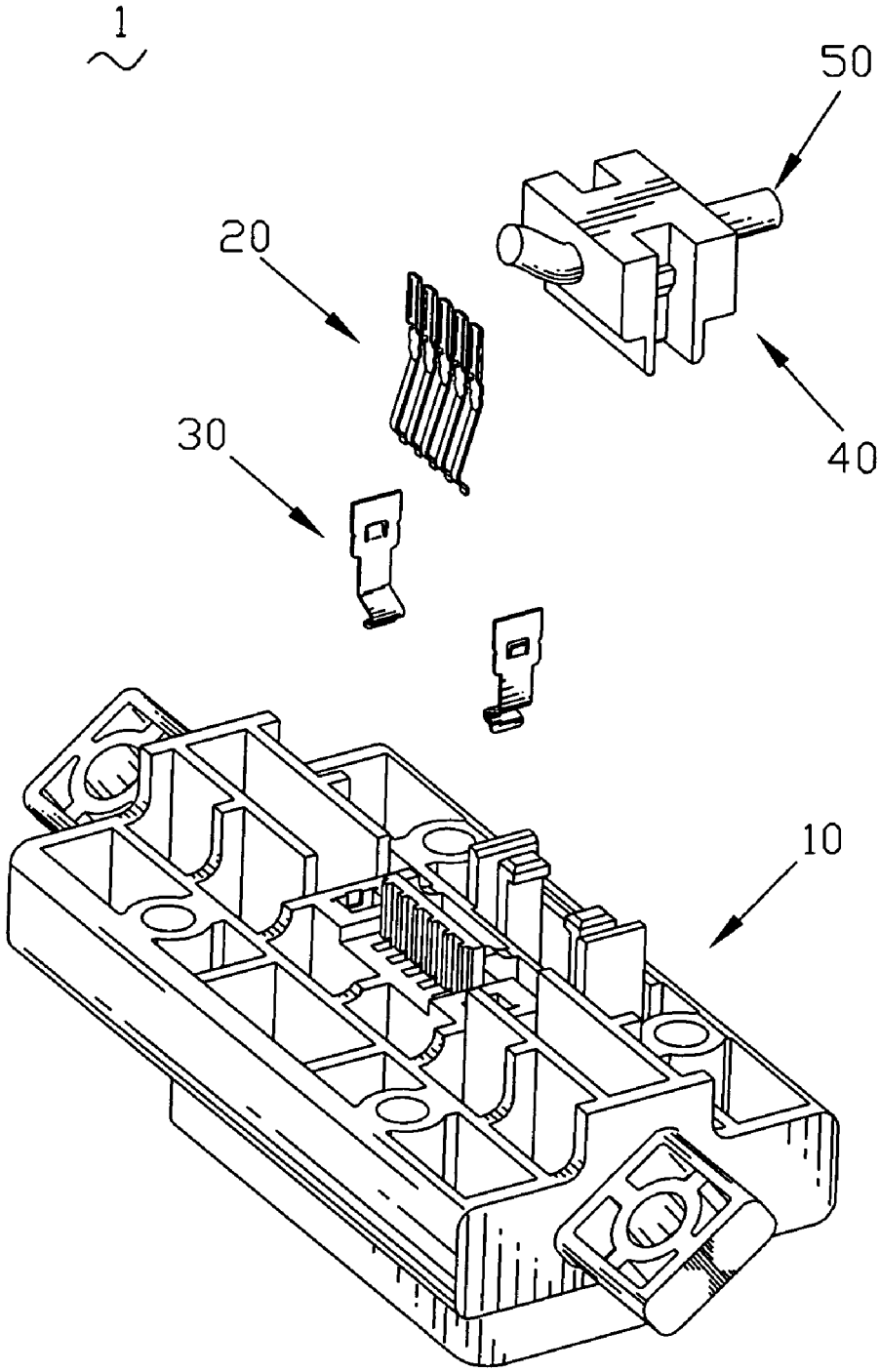
FIG. 1 is an exploded view of a connector assembly of the present invention.

Please refer to FIG. 1, a connector assembly with the cable positioned inside of the present invention includes a housing 10, a plurality of contacts 20 received in the housing 10, a pair of elastic pieces 30, a positioning base 40 and a cable 50 formed together with the positioning base 40.

Figure 2:
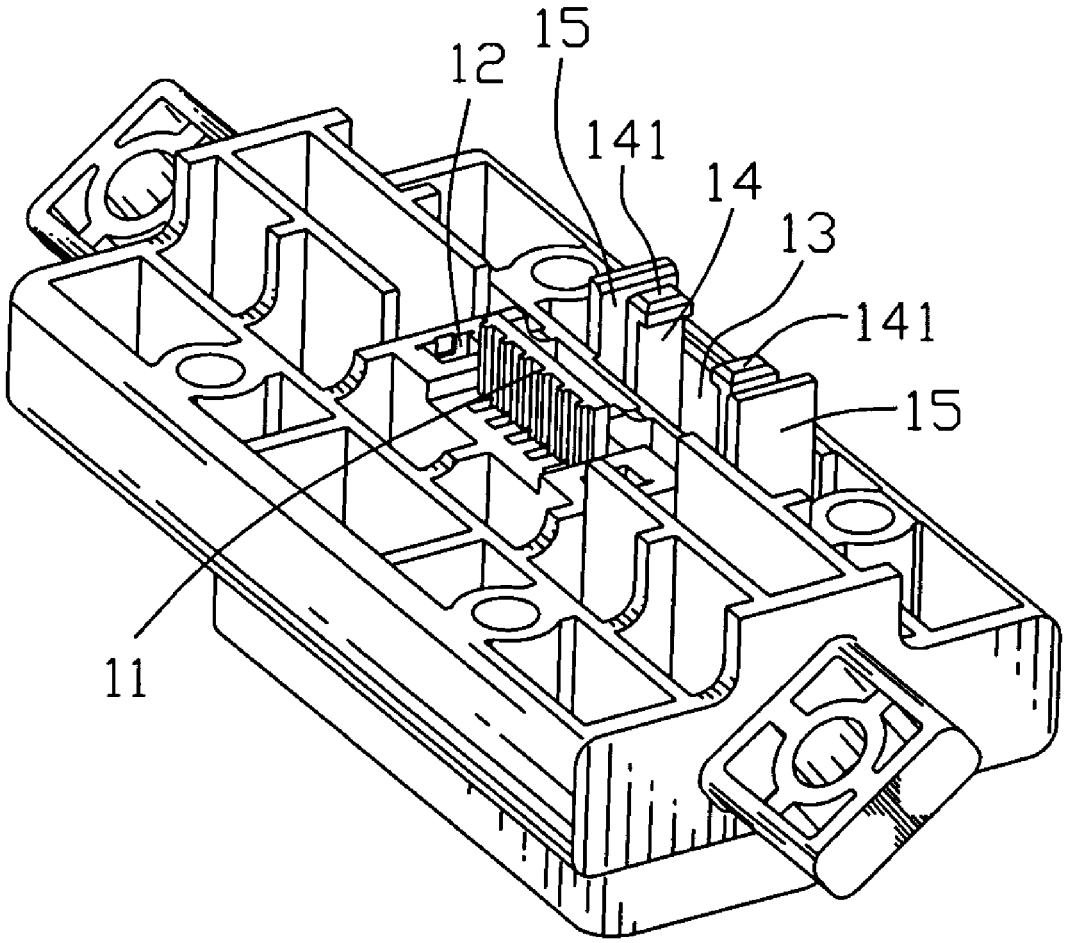
FIG. 2 is a perspective view of a housing shown in FIG. 1.

As shown in FIG. 2, the middle of the top of the housing 10 extends upwards to form a receiving board 11 for receiving the plurality of contacts 20, the housing 10 defines an inlay cavity 12 at each of two sides of the receiving board 11 for receiving the elastic pieces 30. The housing 10 defines a retaining space 13 behind the receiving board 11 and the retaining space 13 is parallel to the receiving board 11. The bottom of the retaining space 13 extends upwards to form a pair of oblong pressing boards 15 parallel to each other. The bottom of the retaining space 13 further extends upwards to form a pair of oblong elastic retaining arms 14 between the two pressing boards 15. The top of the retaining arm 14 extends inwards to define a protuberance 141.

Figure 3:
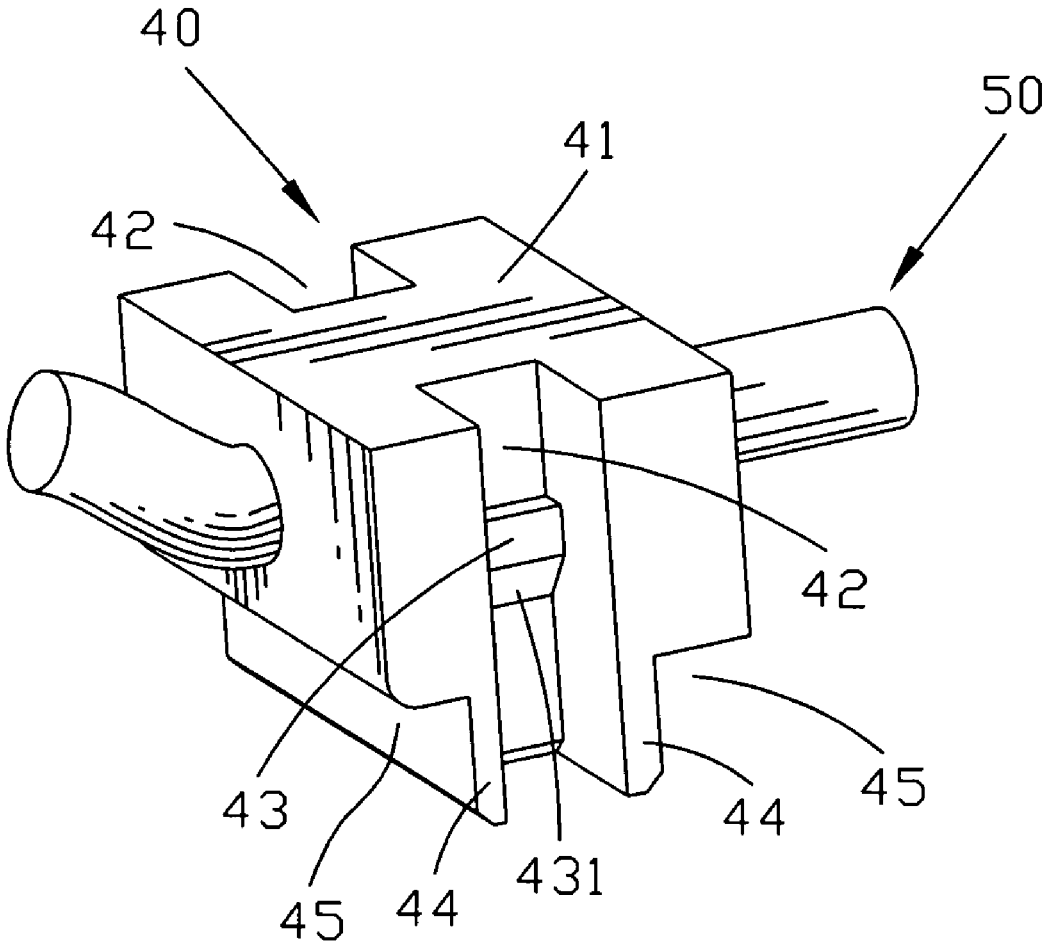
FIG. 3 is a perspective view of a positioning base and a cable shown in FIG. 1.

Referring to FIG. 3, the positioning base 40 has a cuboidal base 41, the cable 50 is formed together with the base 41 and passes through the upper part of two opposite sides of the base 41, the lower parts of the two opposite sides define a cooperating cavity 45 respectively, the cooperating cavity 45 opens through the other two opposite sides and the bottom of the base 41. The other two opposite sides define an oblong retaining cavity 42 respectively. A retaining board 44 is formed between the retaining cavity 42 and the cooperating cavity 45 and is wedged in the retaining space 13. The middle of the inner surface of the retaining cavity 42 protuberates outwards to define a wedge-shaped retaining projection 43 for cooperating with the protuberance 141 of the retaining arm 14. A ramp 431 is formed between the lower surface of the retaining projection 43 and the inner surface which the retaining projection 43 mounted on for guiding the protuberance 141 to cooperate with the retaining projection 43.

Figure 4:
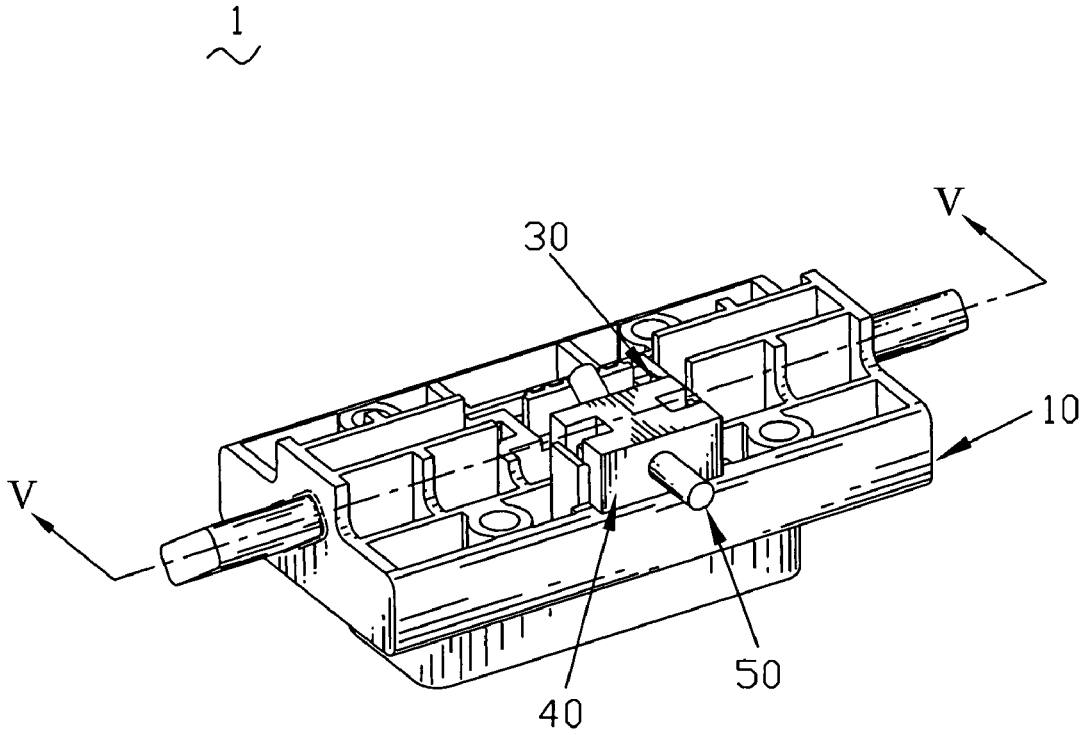
FIG. 4 is a perspective assembled view of the connector assembly.
Figure 5:
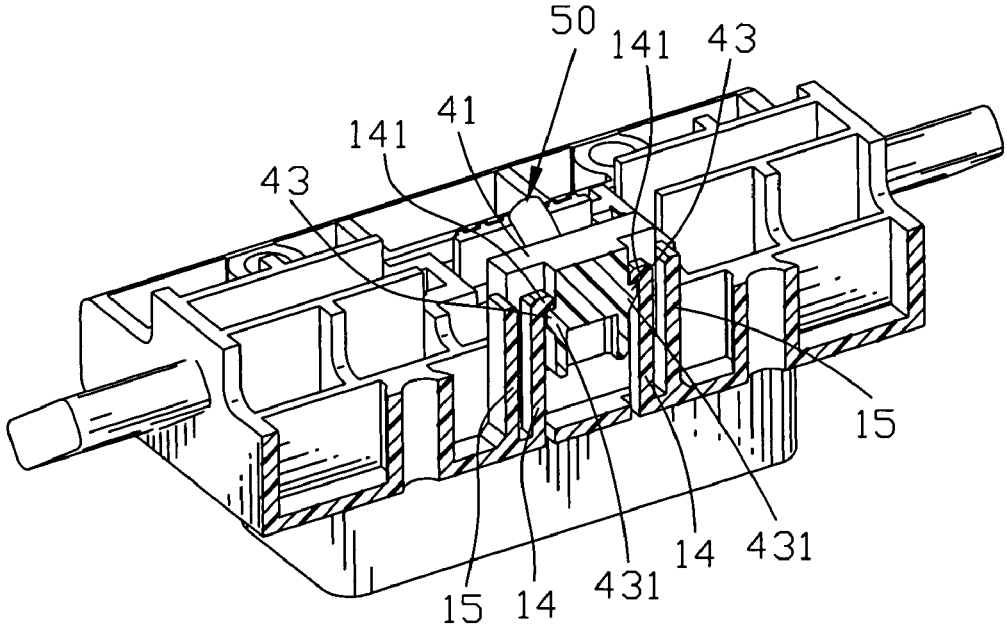
FIG. 5 is a cross-sectional view along V-V shown in FIG. 4.

Please refer to FIGS. 4 and 5, showing the connector assembly with the cable positioned inside. At first, the retaining board 44 is inserted into the retaining space 13 and wedged between the retaining arm 14 and the sidewall of the retaining space 13. Two pressing boards 15 elastically press the two opposite sides that the retaining cavities 42 defined on. The retaining arm 14 stretches into the retaining cavity 42, the protuberance 141 slides upwards along with the ramp 431 and then presses against the top of the retaining projection 43, thereby, the positioning base 40 is positioned in the housing 10. Secondly, the plurality of contacts is connected to one end of the cable 50, the other end of the cable 50 stretches out of the housing 10. Finally, the connector assembly 1 is connected to an outer device (not shown).

In use, as the cable 50 is formed together with the positioning base 40 and further the positioning base 40 is positioned in the connector assembly 1, when the cable 50 is pulled unintentionally, the cable 50 is incapable to be moved away from the housing 10 and then the cable 50 is impossible to be loosened from the contacts 20 at the soldering portion, as a result, the electrical connection between the housing 10 of the present invention and the cable 50 is stable and the transmitting of the electronic signal is also stable.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A connector assembly, comprising:

a housing, the housing extending upwards to form a pair of elastic retaining arms, the housing extending upwards to form a pair of pressing boards, the elastic retaining arms formed between the two pressing boards;

a plurality of contacts received in the housing;

a positioning base wedged in the housing, the pressing boards elastically pressing two opposite sides of the positioning base, the positioning base having a retaining cavity defined in each of two opposite sides of the positioning base respectively, the inner surface of the retaining cavity protuberating outwards to define a retaining projection for cooperating with the retaining arm; and a cable formed together with the positioning base, one end of the cable being connected to the contacts, the other end of the cable stretching out of the housing.

2. The connector assembly as claimed in claim 1, further comprising a receiving board for receiving the plurality of contacts.

3. The connector assembly as claimed in claim 2, wherein the top of the retaining arm extends inwards to define a protuberance, the protuberance pressing against the top of the retaining projection.

4. The connector assembly as claimed in claim 3, wherein the retaining projection is wedge-shaped, a ramp formed between the lower surface of the retaining projection and the inner surface which the retaining projection mounted on, the protuberance sliding upwards along with the ramp and then pressing against the top of the retaining projection.

5. A connector assembly, comprising:

a housing, the housing extending upwards to form a pair of elastic retaining arms, the housing defines a retaining space, the bottom of the retaining space extending upwards to form a pair of pressing boards, the retaining arms mounted between the two pressing boards;

a plurality of contacts received in the housing;

a positioning base wedged in the housing, having a retaining cavity defined in each of two opposite sides of the positioning base respectively, the inner surface of the retaining cavity protuberating outwards to define a retaining projection for cooperating with the retaining arm, the pressing boards elastically pressing the two opposite sides of the positioning base which the retaining cavities are defined on; and a cable formed together with the positioning base, one end of the cable being connected to the contacts, the other end of the cable stretching out of the housing.

* * * * *